United States Patent [19]

Howell

[11] Patent Number: 4,644,309

[45] Date of Patent: Feb. 17, 1987

[54] HIGH SPEED CONTACT DRIVER FOR CIRCUIT INTERRUPTION DEVICE

[75] Inventor: Edward K. Howell, Simsbury, Conn.

[73] Assignee: General Electric Company, New York, N.Y.

[21] Appl. No.: 839,678

[22] Filed: Mar. 14, 1986

Related U.S. Application Data

[63] Continuation-in-part of Ser. No. 814,865, Dec. 30, 1985.

[51] Int. Cl.[4] ..... H01H 77/10

[52] U.S. Cl. ..... 335/195; 200/147 R; 335/147

[58] Field of Search ..... 335/195, 147, 16; 200/147 R

[56] References Cited

U.S. PATENT DOCUMENTS

| | | | |
|---|---|---|---|
| 1,720,566 | 7/1929 | Pestarini | 335/16 |
| 3,002,065 | 9/1961 | La Tour, Jr. | 335/147 |
| 3,168,626 | 2/1965 | Patrick | 335/147 |
| 3,215,796 | 11/1965 | Leisi | 335/16 |
| 4,039,983 | 8/1977 | Terracol et al. | 335/16 |

*Primary Examiner*—Harold Broome

*Attorney, Agent, or Firm*—Richard A. Menelly; Walter C. Bernkopf; Fred Jacob

[57] ABSTRACT

A bridging contact is arranged across two fixed contacts with a pair of parallel, closely spaced conductors serving as the bridging contact carrier. A high current pulse in opposite direction within the parallel conductors generates electrodynamic forces rapidly propelling the conductors further apart. The bridging contact carried by the parallel conductors is rapidly driven out of contact relation with the fixed contacts to interrupt the circuit.

6 Claims, 8 Drawing Figures

HIGH SPEED CONTACT DRIVER FOR CIRCUIT INTERRUPTION DEVICE

This is a continuation-in-part of co-pending Ser. No. 814,865, filed Dec. 30, 1985.

BACKGROUND OF THE INVENTION

The advent of a practical solid state current limiting interrupter such as described in U.S. patent application Ser. No. 610,947 filed May 16, 1984 in the name of E. K. Howell has provided a synergistic relationship between the circuit interrupter contacts and the contact operating mechanism. By employing a solid state switch in parallel with the contacts, the current is diverted away from the contacts immediately upon contact separation to substantially reduce the arcing energy and hence essentially eliminates the deleterious arcing effect on the contacts. This in turn allows the contacts to be made much smaller and hence reduces both their thermal and inertial mass. The reduction in the inertial mass in turn allows the contacts to be more rapidly separated and hence allows circuit interruption during the early stages of the current wave form. The lower contact inertial mass allows the use of a bridging contact between a pair of fixed contacts such as described in U.S. patent application Ser. No. 674,810, filed Nov. 26, 1984, entitled "Current Limiting Circuit Breaker" in the name of E. K. Howell. The bridging contact arrangement provides for a further reduction in the mass of the contacts such that even more rapid contact separation can be attained and allows the current interruption to occur at the correspondingly earlier stages of the current waveform.

The aforementioned patent applications are incorporated herein for reference purposes and should be reviewed for a good description of the operation of a solid state switch for circuit interruption as well as for describing the configuration of a bridging electrode arrangement.

The instant invention is directed toward a high speed contact driver for rapidly separating bridging contacts from a pair of fixed contacts such as described in the latter referenced patent application.

U.S. Pat. No. 3,215,796 in name of Bruno Leisi, discloses the idea of utilizing line current to induce current in a current loop including closely spaced parallel conductors to drive the conductors apart and to separate movable contacts from associated fixed contacts.

U.S. Pat. No. 3,168,626 in the name of Richard Patrick, discloses a fuse utilizing the repulsive forces developed by fault currents flowing in opposite directions through closely spaced, parallel fuse links to sever one or both links and thus interrupt the faulted circuit.

U.S. Pat. No. 3,002,065 in the name of John LaTour, Jr., discloses the use of excessive line currents flowing in opposite direction through conductive columns to repulse one of the columns and thus provide a shunt path to protect a meter.

U.S. Pat. No. 1,720,566 in the name of Joseph Pestarini discloses a circuit controlling device which utilizes a magnetic force to enhance the electromagnetic separation of a bridging contact from a pair of fixed contacts.

U.S. Pat. No. 4,039,983 in the names of Claude Terracol et al. discloses a high speed circuit interrupter having both main contacts and arcing contacts. The main contacts employ a bridging contact for operation and the arcing contacts utilize electrodynamic forces to hold the arcing contacts closed for a short period of time after separation of the bridging contact from the main contact.

The purpose of the instant invention is to provide a high speed contact driver arrangement wherein a high current pulse is employed to electrodynamically repulse a pair of conductors serving as a contact carrier for a bridging contact arranged across a pair of contacts within a protected circuit for extremely fast circuit interruption upon command.

SUMMARY OF THE INVENTION

The invention comprises a high speed contact driver wherein a bridging contact is resiliently supported by means of a cantilever spring and is carried by a pair of closely spaced electrical conductors. The bridging contact is biased into electrical contact relation with a pair of stationary contacts by means of a contact spring. A pulse of current applied to the conductors results in the electrodynamic repulsion of the conductors and the lifting of the bridging contact away from the stationary contacts against the bias of the contact spring.

DESCRIPTION OF THE PREFERRED EMBODIMENT

Figure 1:
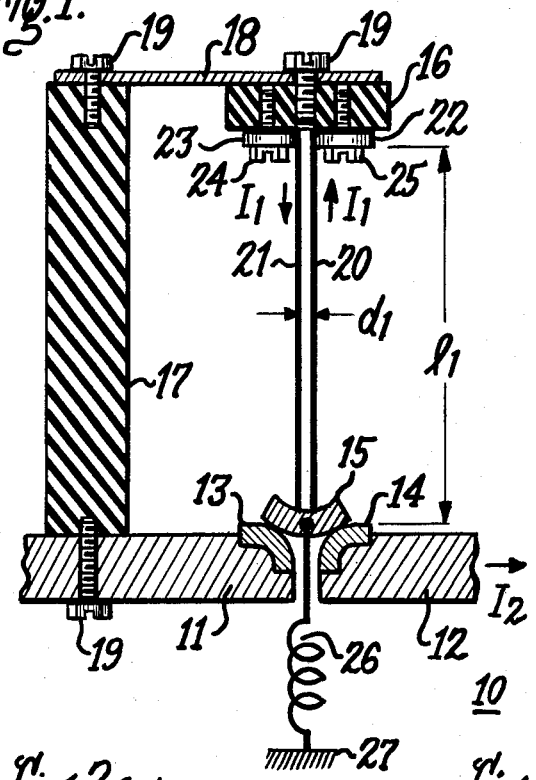
FIG. 1 is a plan view in partial section of the high speed contact driver according to the invention.

An illustrative embodiment of the high speed contact driver 10 of the invention is shown in FIG. 1 wherein a pair of rigid conductors 11, 12 each carrying a fixed contact 13, 14 are connected by means of a bridging contact 15. The bridging contact is carried by a pair of conductors 20, 21 which are attached to the bridging contact at one end so that the bridging contact electrically connects the two conductors in series. The opposite ends of the two conductors are respectively connected in series with a pair of terminal connectors 22, 23 by means of terminal screws 24, 25. Electrical connection is made to the two conductors by attaching a current source to the terminal screws. A block of insulating material 16 of a predetermined mass $M_1$ is attached to one end of a cantilever spring 18 by means of a screw 19 and the spring is attached to a support 17 at the opposite end by means of a separate screw. The mass $M_2$ of the bridging contact 15 is selected to be very small with respect to the mass $M_1$ of the insulating material. A contact spring 26 is attached to the bridging contact at one end and the other end is fixedly attached to a support 27. The tension supplied by contact spring 26 is adjusted to hold the bridging contact into good electrical connection with the fixed contacts in opposition to the force exerted by the cantilever spring 18 on the bridging contact via the tensile force in conductors 20, 21. Cantilever spring 18 compensates for variations in the length of the conductors and can be eliminated, replaced by a rigid supporting member, when the length of the conductors is carefully controlled. Further, contact spring 26 can be eliminated by utilizing the stiffness of the conductors themselves to provide the holding force on the contacts. When the contact driver 10 is used within a circuit interrupter, the circuit current $I_2$ transfers between the rigid conductors 11, 12 in the indicated direction, through the fixed contacts 13, 14 and the bridging contact 15 in the manner described in the aforementioned U.S. patent application entitled "Current Limiting Circuit Breaker". The length $l_1$ of the conductors 20, 21 and the separation distance $d_1$ is adjusted to ensure that a predetermined controlled current pulse $I_1$ in the indicated directions, will produce sufficient electrodynamic repulsion between the two conductors to overcome the bias provided by the contact spring 26 and to rapidly separate the bridging contact from the fixed contacts within a time increment of 10–100 microseconds from the initiation of the current pulse $I_1$.

Figure 2A:
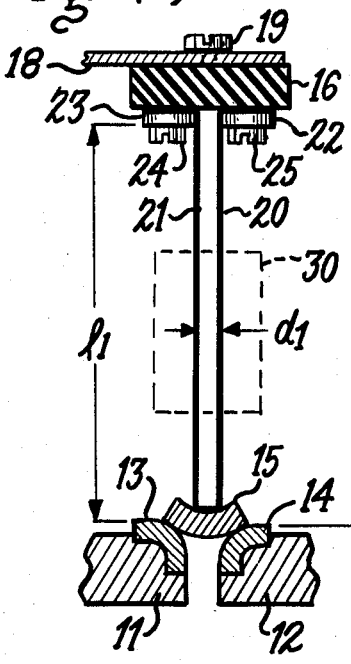
FIGS. 2A and 2B represent plan views in partial section of the contact driver of FIG. 1 before and after excitation.
Figure 2B:
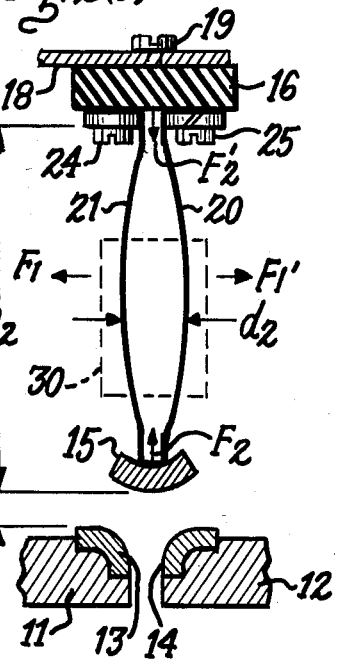

The current loop provided between the terminal screw 24, conductor 21, bridging contact 15, conductor 20 and terminal screw 25 is depicted at FIG. 2(*a*) with no current flowing through the loop. The magnetic field represented by rectangle 30 resulting from the current flow through the conductors can be augmented by the use of magnetic material such as 3% silicon steel, for example. The addition of a permanent magnet or an auxiliary winding to the magnetic structure can further create a magnetic field component which is independent of current in the conductors. The substantial increase in the electrodynamic repulsion forces exerted upon the conductors by the addition of the magnetic field will be described below with reference to FIG. 3.

The effect of the electrodynamic forces represented as $F_1$ and $F_1'$ in the indicated directions, is shown in FIG. 2(*b*) for comparison to FIG. 2(*a*). It is noted that the separation distance $d_2$ between the two conductors upon electrodynamic repulsion, is substantially larger than the initial separation distance $d_1$ and that the bridging contact 15 has separated from the fixed contact 13 by an increment $dl_1$. The large separation distance $d_2$ is the effect of the repulsion force $F_1$, which is proportional to the product of current $I_1$, times the magnetic field strength exerted by magnetic field 30. The force on the bridging contact is represented by the force vector $F_2$ which is exerted in the indicated direction, with an equal magnitude force $F_2'$ exerted in the opposite direction on block 16. Since the mass $M_2$ of bridging contact 15 is much smaller than the mass $M_1$ of block 16, equal forces $F_2$ and $F_2'$ will produce a much larger acceleration of bridging contact 15 than of block 16. Thus in the 100 microsecond time frame, block 16 remains essentially stationary.

Figure 3:
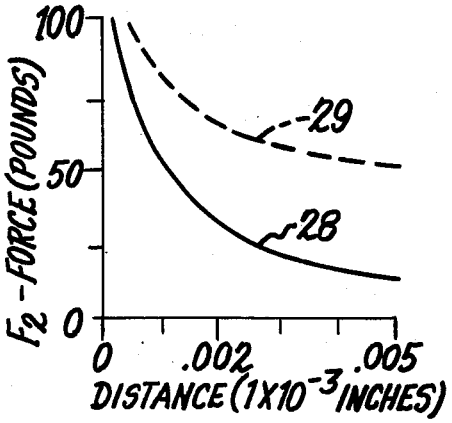
FIG. 3 is a graphic representation of the bridging contact separation force relative to the separation distance between the bridging contact and the stationary contacts.

The variation in the force $F_2$ on the bridging contact 15 as a function of the separation distance between the bridging contact and the fixed contacts 13, 14 in the magnetic field 30, is shown at 28 in FIG. 3. It is noted that the force $F_2$ on the bridging contact is very high initially, in the order of one hundred pounds, to provide a high acceleration when the current pulse $I_1$ is first applied and decreases rapidly as the bridging contact 15 becomes separated from the fixed contacts 13, 14 and the separation distance increases from zero to a few thousandths of an inch. The effect of augmentation of the magnetic field 30 is shown at 29 to increase the force exerted on the bridging contact at larger contact separation distances.

Figure 5A:
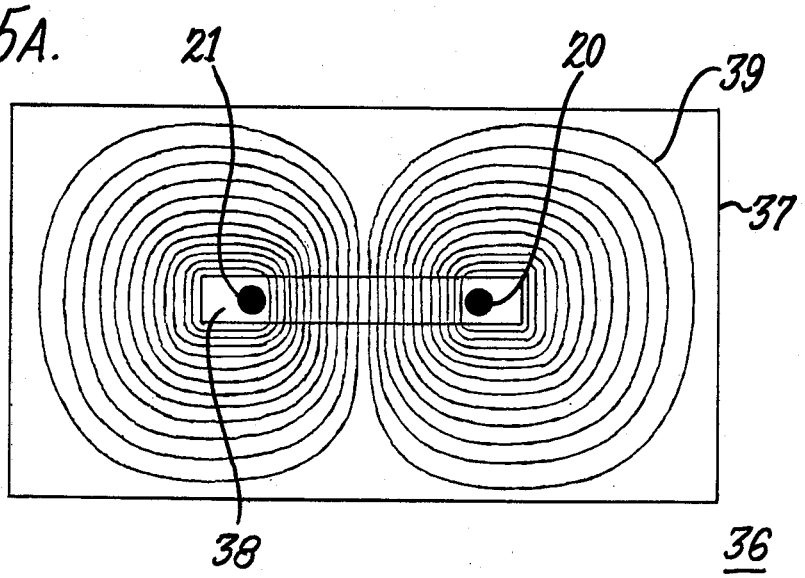
FIGS. 5A–5C are enlarged top views of the magnetic plates used to provide the magnetic field depicted in FIGS. 2A and 2B.
Figure 5B:
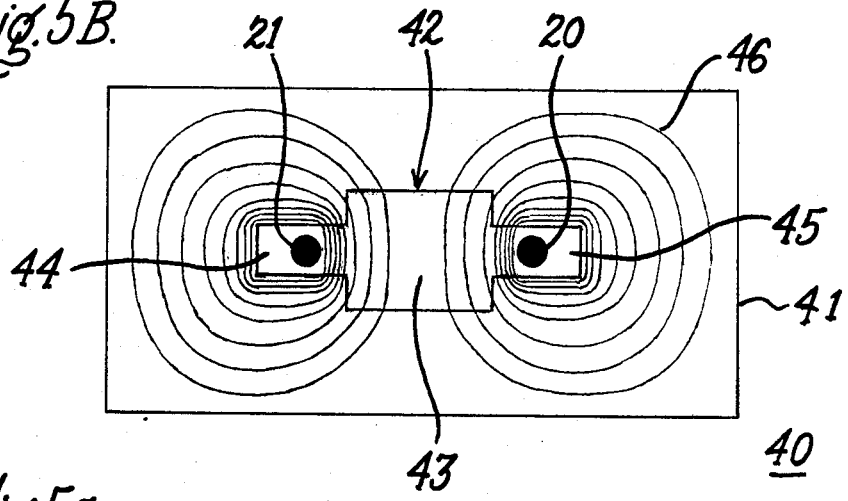
Figure 5C:
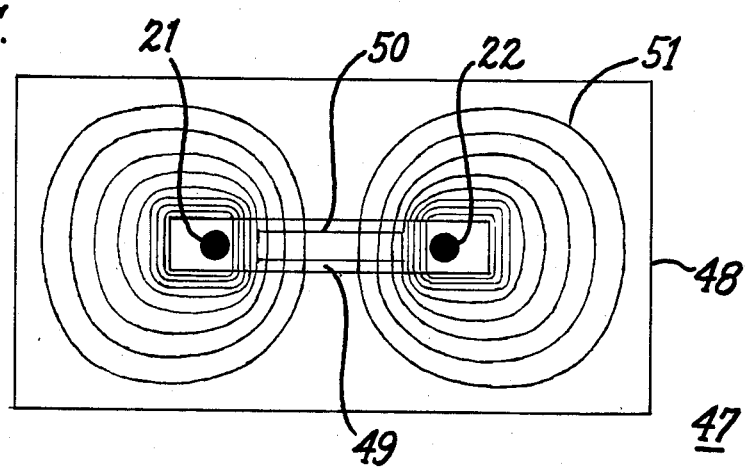

The magnetic field augmentation is provided by a magnetic structure 36 shown in FIG. 5A consisting of a stack of thin metal sheets 37 of silicon steel having a rectangular slot 38 through which the conductors 20, 21 extend. Magnetic flux lines 39 depict the path of the magnetic flux within the sheets. It is noted that the magnetic flux lines are concentrated approximately around the center of the wires and decrease in proportion to the distance away from the center. When a high current pulse is applied to the conductors, the magnetic flux induced within the metal sheets is in the order of several thousand gauss such that wide metal sheets compared to the small diameter of the conductors are required to ensure that the metal does not become saturated with the magnetic flux. By using the magnetic structure such as indicated at 40 in FIG. 5B consisting of a stack of metal sheets 41 having a cruciform slot 42, consisting of a larger rectangular slot 43 in the region of the metal sheets between the conductors and a narrower slot such as slot 44 outboard conductor 21 and a narrower slot 45 outboard conductor 20, the amount of metal within the sheets is reduced. Magnetic flux lines 46 exhibit the same magnetic force as the flux lines 39 within the magnet motor 36 of FIG. 5A. When a current pulse of extremely short duration, such as less than one millisecond, is applied to the conductors, the magnetic flux induced within the metal sheets changes rapidly. To reduce peak flux in the gap region between the conductors, a metal insert 50 is arranged within slot 49 such as shown in the magnet motor 47 depicted in FIG. 5C. Metal sheet 48 is similar in width to that of slot 43 depicted earlier in FIG. 5B. The metal insert 50 of aluminum, copper or any other conductive non-magnetic metal produces eddy currents in response to the rapid change of the magnetic flux. The eddy currents, in turn, oppose the change of flux which effectively lowers the peak magnetic flux in the gap region between the conductors.

Figure 4:
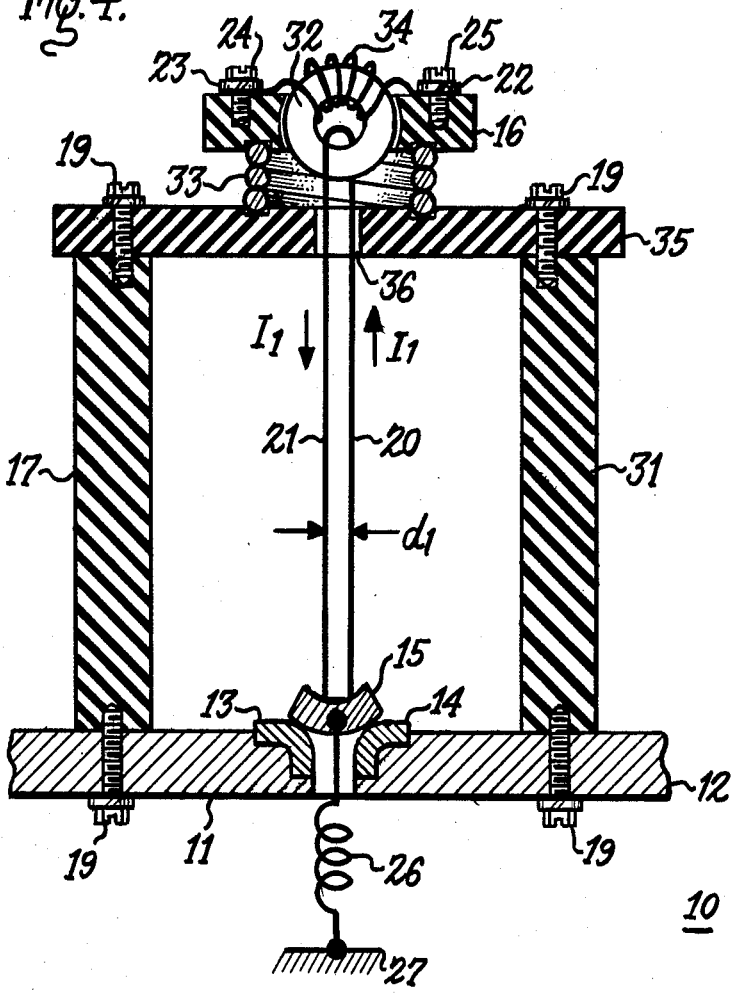
FIG. 4 is a plan view in partial section of an alternate embodiment of the high speed contact driver shown in FIG. 1.

A further embodiment of the high speed contact driver 10 of FIG. 1 is shown in FIG. 4 and similar reference numbers will be employed where possible. The current loop is provided between conductor 20, bridging contact 15 and conductor 21. A platform 35 of insulating material, supported by a pair of support posts 17, 31 also of insulating material, has an opening 36 for the passage of the two conductors and serves to support a helix spring 33 which biases the bridging contact against the bias of contact spring 26 in a manner similar to the cantilever spring 18 described earlier with reference to the arrangement depicted in FIG. 1. The platform and the rigid conductors 11, 12 are attached to the support posts 17, 31 by means of screws 19, as indicated. The conductors 20, 21 are arranged as a single turn secondary winding around a toroidal core 32, with the multi-turn primary winding 34 connected to external circuitry by means of terminal connectors 22, 23 and terminal screws 24, 25. The toroidal core is secured to insulative block 16 and adds to the mass of block 16 for the advantageous relation between this mass and the mass which comprises the bridging contact as described earlier. A current pulse applied to terminal connectors 22, 23 is amplified by transformer action through the core and is induced within the conductors 20, 21 to provide the predetermined current $I_1$ which flows in the indicated directions to separate the conductors.

It has thus been shown that extremely fast contact separation can be achieved against a large contact holding force, such as exerted by the contact spring 26 on a small contact mass such as $M_1$ relative to a lesser contact separating force, such as provided by the cantilever spring 18 on a large mass such as $M_2$. When electrodynamic forces are provided to increase the contact separation force, the large mass remains virtually stationary resulting in a large acceleration during the initial contact separation which is highly desired for limiting the amount of switching current. It is understood that higher current pulses such as represented by $I_1$ can be employed along with stronger magnetic fields to further increase the separation forces and to provide even faster contact separation.

Having described my invention, what I claim as new and desire to secure by Letters Patent is:

1. A high speed contact driver for electric circuit interruption comprising:

a pair of first and second electrical conductors each fixedly attached at one end to an insulated support and arranged side by side, and extending proximate each other;

a bridging contact carried by said electrical conductors at an opposite end thereof to electrically connect said conductors in series, said bridging contact being electrically connected between a pair of fixed contacts;

terminal means for supplying a predetermined current pulse to said conductors at said one end for electrodynamic repulsion of said conductors away from each other to separate said bridging contact from said fixed contacts upon command; and magnetic means arranged intermediate said ends of said conductors for enhancing said electromagnetic repulsion of said conductors, said magnetic means comprising a plurality of metal plates defining a slot and wherein said first and second electrical conductors are arranged within said slot.

2. The high speed contact driver of claim 1 wherein said slot comprises a rectangular configuration.

3. The high speed contact driver of claim 1 wherein said slot comprises a cruciform configuration.

4. The high speed contact driver of claim 1 wherein said slot comprises a dual width slot, the width of said slot intermediate said first and second conductors being greater than the width of said slot outboard said first and second conductors.

5. The high speed contact driver of claim 1 further including a metal insert within said slot intermediate said first and second electrical conductors.

6. The high speed contact driver of claim 1 wherein said metal insert comprises a non-magnetic metal.

* * * * *